US011072902B2

(12) United States Patent
Clark et al.

(10) Patent No.: US 11,072,902 B2
(45) Date of Patent: Jul. 27, 2021

(54) FORMS FOR CONSTRUCTING FOUNDATIONS FOR ANCHORING POLE VAULT STANDARDS

(71) Applicant: Sportsfield Intellectual, LLC, Delhi, NY (US)

(72) Inventors: Sean R. Clark, Delhi, NY (US); Andrew P. Hannigan, Delhi, NY (US)

(73) Assignee: SPORTSFIELD INTELLECTUAL, LLC, Delhi, NY (US)

( * ) Notice: Subject to any disclaimer, the term of this patent is extended or adjusted under 35 U.S.C. 154(b) by 0 days.

(21) Appl. No.: 16/826,398

(22) Filed: Mar. 23, 2020

(65) Prior Publication Data

US 2020/0270880 A1 Aug. 27, 2020

Related U.S. Application Data

(62) Division of application No. 15/681,901, filed on Aug. 21, 2017, now Pat. No. 10,604,952.

(51) Int. Cl.
*E02D 27/42* (2006.01)
*E02D 27/32* (2006.01)
(Continued)

(52) U.S. Cl.
CPC ..... *E02D 27/42* (2013.01); *E02D 27/02* (2013.01); *E02D 27/30* (2013.01); *E02D 27/32* (2013.01);
(Continued)

(58) Field of Classification Search
CPC ..... A63B 5/02; A63B 5/06; A63B 71/023; A63B 6/02; E02D 27/42; E02D 27/02; E02D 27/32; E01C 13/00
(Continued)

(56) References Cited

U.S. PATENT DOCUMENTS 315,840 A * 4/1885 Roberts ..... F16M 5/00 248/678
468,625 A 2/1892 Medart
(Continued)

FOREIGN PATENT DOCUMENTS

FR 2601061 A1 * 1/1988 ..... F24B 1/1806

OTHER PUBLICATIONS

7141 & 7142—National Pole Vault Standards, available from gillathletics.com, printout available online on Jun. 26, 2017, at: https://www.gillathletics.com/files/inst-7141-7142.pdf, 7-pages Jan. 10, 2013.

(Continued)

*Primary Examiner* — Michael Safavi
(74) *Attorney, Agent, or Firm* — Heslin Rothenberg Farley & Mesiti P.C.

(57) ABSTRACT

A form for constructing a foundation for anchoring a pole vault standard to a support structure adjacent to a landing pad includes a first frame and a first plurality of connectors defining a first connecting pattern for coupling to a corresponding connecting pattern of a base of the first pole vault standard. The form is installable in the support structure and operable for use in fixedly connecting the first base of the pole vault standard to the form. A pair of forms may be employed for constructing a pair of foundations for anchoring a pair of pole vault standards to a support structure adjacent to a landing pad.

40 Claims, 9 Drawing Sheets

(51) Int. Cl.

| | |
|---|---|
| ***E02D 27/02*** | (2006.01) |
| ***A63B 5/02*** | (2006.01) |
| ***E04G 9/06*** | (2006.01) |
| ***E02D 27/30*** | (2006.01) |
| *E01C 13/02* | (2006.01) |
| *A63B 71/02* | (2006.01) |
| *A63B 5/06* | (2006.01) |
| *A63B 6/02* | (2006.01) |

(52) U.S. Cl.
CPC ..... *E04G 9/06* (2013.01); *A63B 5/02* (2013.01); *A63B 5/06* (2013.01); *A63B 6/02* (2013.01); *A63B 71/023* (2013.01); *A63B 2209/00* (2013.01); *A63B 2225/093* (2013.01); *E01C 13/02* (2013.01)

(58) Field of Classification Search
USPC ..... 248/673, 677, 678, 679, 346.01, 346.02, 248/346.03; 482/14, 15, 16, 17; 52/741.14, 741.15
See application file for complete search history.

(56) References Cited

U.S. PATENT DOCUMENTS 1,813,045 A * 7/1931 Franks ..... F16M 5/00 248/656
1,887,033 A 11/1932 Merriman
2,014,466 A * 9/1935 Cheyney ..... F16M 5/00 248/632
2,064,751 A * 12/1936 Hussman ..... F16F 15/06 248/544
2,200,859 A * 5/1940 Leonard ..... F16F 15/067 248/619
2,236,935 A 4/1941 Cameron
2,294,855 A * 9/1942 Thomason ..... E01F 1/00 248/544
2,588,722 A 3/1952 Hendershott
2,678,592 A * 5/1954 Wiedman ..... B67D 7/84 404/7
2,828,931 A * 4/1958 Harvey ..... B65D 19/0095 410/46
2,960,335 A 11/1960 Shuttleworth
3,222,064 A 12/1965 Langton
3,395,917 A 8/1968 Moore
3,421,801 A * 1/1969 Carpenter ..... A47B 63/00 312/111
3,477,668 A * 11/1969 Tippmann ..... F16M 5/00 248/646
3,493,201 A * 2/1970 Marran ..... F16M 7/00 248/678
3,815,902 A 6/1974 Tomlinson
4,089,553 A 5/1978 Frykholm
4,212,446 A * 7/1980 Domanick ..... F16M 5/00 248/346.03
4,215,857 A 8/1980 Gordon
4,245,838 A 1/1981 Gordon
4,323,034 A 4/1982 Carlson
4,502,656 A * 3/1985 Zeitler ..... F16M 11/041 248/346.03
4,505,449 A * 3/1985 Turner ..... F16M 5/00 248/346.03
4,696,470 A 9/1987 Fenner
5,205,799 A 4/1993 Carbonero
1,928,280 A 9/1993 Milton
5,611,974 A * 3/1997 Welch ..... B29C 67/243 264/34
6,152,430 A 11/2000 Thoman
6,325,352 B1 * 12/2001 Story ..... H04Q 1/02 108/55.1
6,427,966 B1 * 8/2002 Blumenschein ..... A47B 91/005 248/646
7,527,569 B2 5/2009 Rogers
7,736,274 B2 6/2010 Thibodeaux, Sr.
7,753,826 B1 7/2010 Oliver et al.
7,798,920 B1 9/2010 Cortes
8,016,149 B2 9/2011 Goulet
8,186,684 B2 5/2012 Oliver
8,234,888 B2 * 8/2012 Kim ..... D06F 39/125 312/198
8,337,318 B2 12/2012 Oliver
8,376,479 B2 * 2/2013 Furey ..... H05K 7/1424 211/26
8,777,784 B2 7/2014 Rogers
9,932,893 B2 * 4/2018 Nandigama ..... F16M 5/00
10,604,952 B2 3/2020 Clark
2005/0172678 A1 * 8/2005 Kim ..... A47B 91/005 68/3 R
2009/0275444 A1 11/2009 Derry
2014/0048678 A1 * 2/2014 Chen ..... F16M 7/00 248/678
2015/0054369 A1 * 2/2015 Ahlert ..... H02K 5/26 310/91
2016/0281907 A1 * 9/2016 Perko ..... E02D 5/56
2017/0248268 A1 * 8/2017 Copanas ..... F16M 7/00

OTHER PUBLICATIONS

PVS-NCAA Collegiate Premier Pole Vault Standards, available from Aluminum Athletic Equipment Co., Royersford, Pennsylvania, printout available online on Jun. 26, 2017, at: https://www.aaesports.com/v/vspfiles/assets/docs/pvs-ncaa-packet.pdf, 4-pages Feb. 12, 2012.

Olympian Pole Vault Standards Installation Instructions, available from Stackhouse Athletic Equip Inc., Salem, Oregon, printout available online on Jun. 26, 2017, at: https://www.stackhouseathletic.com/Content/downloads/install/TOPVS-INSTALL.pdf, 4-pages. Dec. 2008.

* cited by examiner

FORMS FOR CONSTRUCTING FOUNDATIONS FOR ANCHORING POLE VAULT STANDARDS

CROSS-REFERENCE TO RELATED APPLICATION

This application is a divisional of U.S. patent application Ser. No. 15/681,901, filed Aug. 21, 2017, entitled "Forms For Constructing Foundations For Anchoring Pole Vault Standards," the entire subject matter of which is incorporated herein by reference.

FIELD OF THE DISCLOSURE

The present disclosure relates generally to pole vaults, and more particularly to forms for constructing foundations for anchoring pole vault standards adjacent to a pole vault landing area.

BACKGROUND

Pole vaulting is a track and field event in which a person uses a long, flexible pole as an aid to jump over a horizontal crossbar. A pair of pole vault standards disposed adjacent to a landing pad support the crossbar that athletes must clear during a pole vault event. Rules and regulations generally require that the pole vault standards be securely anchored to the ground or sufficiently weighted to prevent the possibility of tipping over.

Typically, each of the pole vault standards include a base and a vertical uprights for supporting the crossbar. The most common method for anchoring pole vault standards includes an exposed concrete foundation sized slightly larger than the footprint of the base, allowing for the base to be manually affixed to the concrete with appropriate hardware. By way of traditional methods, the concrete foundations are formed by hand. The size and depth are not controlled, the exposed concrete is left at the surface, and manual drilling must be carefully performed for the anchoring of the hardware. Certain hardware cannot be easily removed or replaced, for example, if epoxied into the concrete.

For a large percentage of new construction applications, the pole vault runway and landing area includes asphalt and/or concrete which is then coated with a resilient rubber track material, typically ½ inch in depth. In such cases, the aforementioned exposed concrete foundations often represent the only hard and unyielding surface in the pole vault event area. In cases where the concrete foundations are recessed ½ inch to allow for coating of the rubber surface, it is then difficult to properly locate the foundations prior to manually drilling and anchoring the hardware. Furthermore, doing so not only risks damage to the newly laid and highly expensive track surface, but creates recessed cavities where water can collect allowing for potential damage in the future as a result of freezing and thawing.

SUMMARY

Shortcomings of the prior art are overcome and additional advantages are provided through the provision, in one embodiment, of a method for forming a first foundation and a second foundation adjacent to a pole vault landing area for anchoring a base of first pole vault standard and a base of a second pole vault standard. The method includes excavating a first portion of the support structure adjacent to one side of a pole vault landing area, excavating a second portion of the support structure adjacent to an opposite side of the pole vault landing area spaced from the excavated first portion of the support structure, providing a first form in the excavated first portion of the support structure, the first form includes a first frame and a first plurality of connectors defining a first connecting pattern for coupling to a corresponding connecting pattern of the first pole vault standard, providing a second form in the excavated second portion of the support structure, the second form includes a second frame and a second plurality of connectors defining a second connecting pattern for coupling to a corresponding connecting pattern of the second pole vault standard, placing uncured cement in the excavated first portion of the support structure and curing the cement to secure the first frame and first plurality of connectors to the support structure, wherein the first plurality of connectors is alignable with the corresponding connecting pattern of the first pole vault standard and operable for use in fixedly securing the first pole vault standard adjacent to the one side of the pole vault landing area, and placing uncured cement in the excavated first portion of the support structure and curing the cement to secure the second frame to the support structure, wherein the second plurality of connectors is alignable with the corresponding connecting pattern of the second pole vault standard and operable for use in fixedly securing a second pole vault standard to the support structure adjacent to the opposite side of the pole vault landing area.

In another embodiment, a pair of forms for constructing a first foundation and a second foundation for anchoring a first pole vault standard and a second pole vault standard to a support structure adjacent to a landing pad is provided. The pair of forms includes, for example, a first form having a first frame and a first plurality of connectors defining a first connecting pattern for coupling to a corresponding connecting pattern of a base of the first pole vault standard, and wherein the first form is fixedly installable in the support structure and operable for use in fixedly connecting the first base of the first pole vault standard to the first form, and a second form having a second frame and a second plurality of connectors defining a second connecting pattern for coupling to a corresponding connecting pattern of the second pole vault standard, and wherein the second form is fixedly installable in the support structure and operable for use in fixedly connecting a base of a second pole vault standard to the second form.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure as described further below is directed to a pair of prefabricated, stay-in-place pole vault standard foundation forms that allow for easy installation and anchoring of pole vault standards. The foundation forms are operable for use in a support structure such as the ground or an asphalt layer and underground or beneath a track or artificial turf in an athletic field. The foundation forms may be prefabricated under manufacturing conditions thereby assuring accuracy and economy. The foundation forms can be readily transported and installed to produce a pair of foundations for anchoring pole vault standards that is permanent and economical. The foundation forms may include a pattern of connectors aligned with and readily connectable to a corresponding pattern of connectors in the bases of the pole vault standards.

Figure 1:
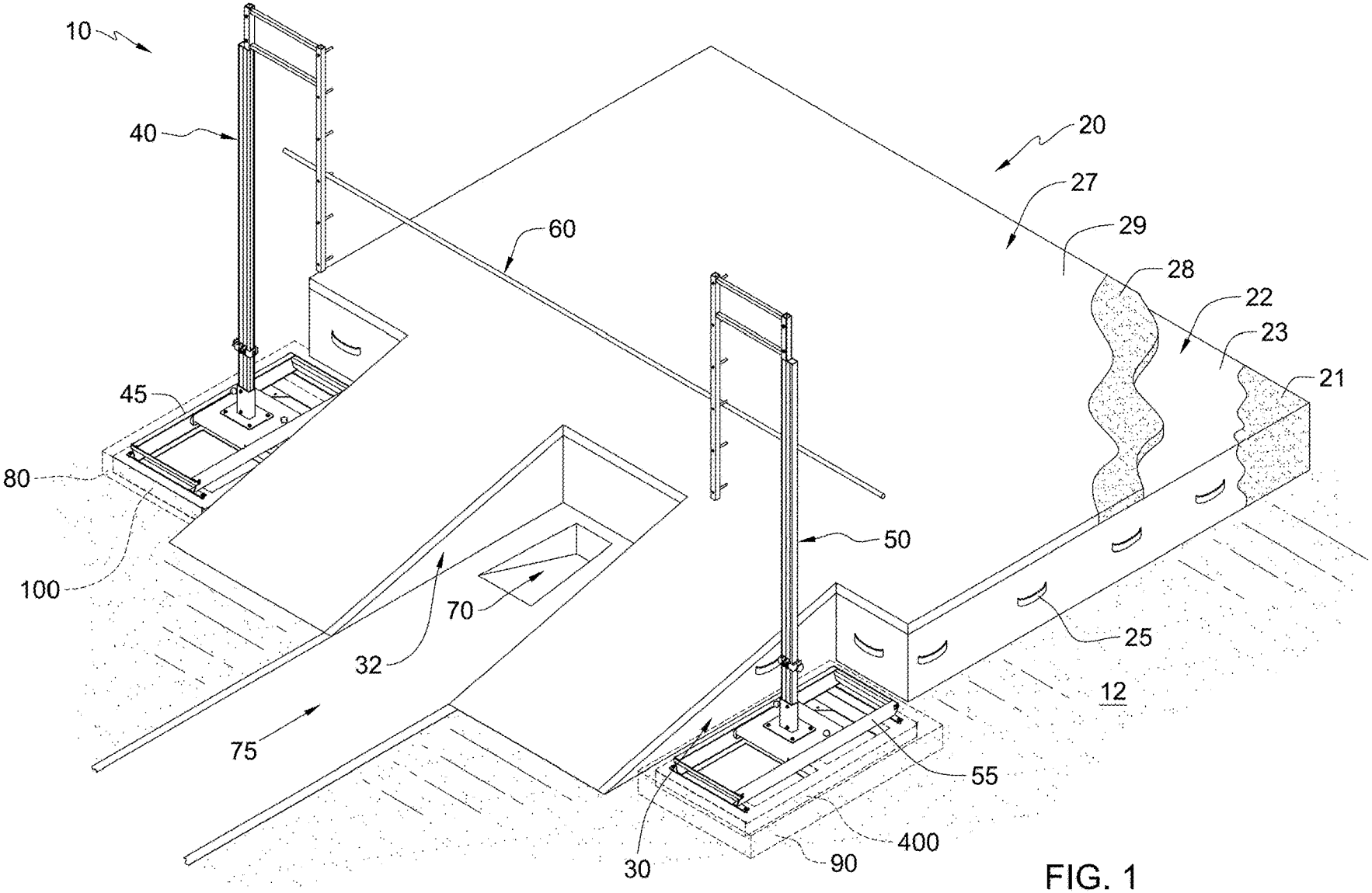
FIG. 1 is a perspective view, partially cut away, of a pole vault system according to an embodiment of the present disclosure.

FIG. 1 illustrates one embodiment of a pole vault system 10 according to an embodiment of the present disclosure disposed on a pole vault landing area 12. For example, pole vault system 10 may include a landing pad 20, a first pole vault standard 40, a second pole vault standard 50, and a crossbar 60. Pole vault landing area 12 may include a planting box 70, an approach 75, and a pair of foundations 80 and 90 for anchoring pole vault standards 40 and 50, respectively. As described in greater detail below, a pair of pole vault standard foundation forms 100 and 400 are employed for use in forming the pair of foundations 80 and 90 for releasably anchoring or fixedly securing first pole vault standard 40 and second pole vault standard 50, respectively, to the support structure adjacent to landing pad 20.

Landing pad 20 may include a main landing pad section 22 disposed behind crossbar 50, and a pair of spaced apart tapered pad sections 30 and 32 disposed in front of crossbar 60 and along sides of planting box 70.

Main landing pad section 22 may include main padding member 21 and a main cover 23 covering main padding member 21. The material forming main padding member 21 may include a suitable polyurethane foam core and may include different layers. Main cover 23 may be formed from a non-porous vinyl material. For example, main cover 23 may be an 18-ounce heavy coated vinyl polyester that has high tear and tensile strengths. Landing pad 20 may include a 2-inch top pad 27 disposed on top of main landing pad section 22 and tapered pad sections 30 and 32 to protect the upper surfaces of main landing upper padding section 22 and tapered pad sections 30 and 32. Top pad 27 may include a padding member 28 and a cover 29. The top pad may be a foam pad which is covered with heavy-duty vinyl coated polyester mesh that is ultraviolet and spike resistant. The main landing pad section 22 may have a generally constant thickness greater than about 20 inches. Each of the tapered sections may include a tapered padding section and a cover, and formed from similar materials used for forming the main landing pad section.

Additional padding sections (not shown in FIG. 1) may be provided and disposed along and covering the outside of bases 45 and 55 of the pair of pole vault standards 40 and 50, respectively. A plurality of handles 25 may be provided along the sides of main landing pad section 22 for use in lifting and positioning the main landing pad section on a surface of a field such as on the ground within or alongside an oval running track. Handles 25 may be 2-inch wide nylon web handles. From the present description, landing pad 20 may include separate main sections and tapered sections, or may be configured to include a unitary structure having the main section and the spaced-apart tapered sections as a single or integrated unit.

For satisfying the National High School Federation (NFHS) specifications and/or requirement, the overall size of the pole vault landing pad may be about 19 feet or about 21 feet wide, about 20 feet or about 23 feet deep, and about 26 inches or about 28 inches high. For satisfying the National High School Federation (NFHS) and the National Collegiate Athletic Association (NCAA) specifications and/or requirement, the overall size of the pole vault landing pad may be about 21½ feet wide, about 24 feet deep, and about 32 inches high.

Figure 2:
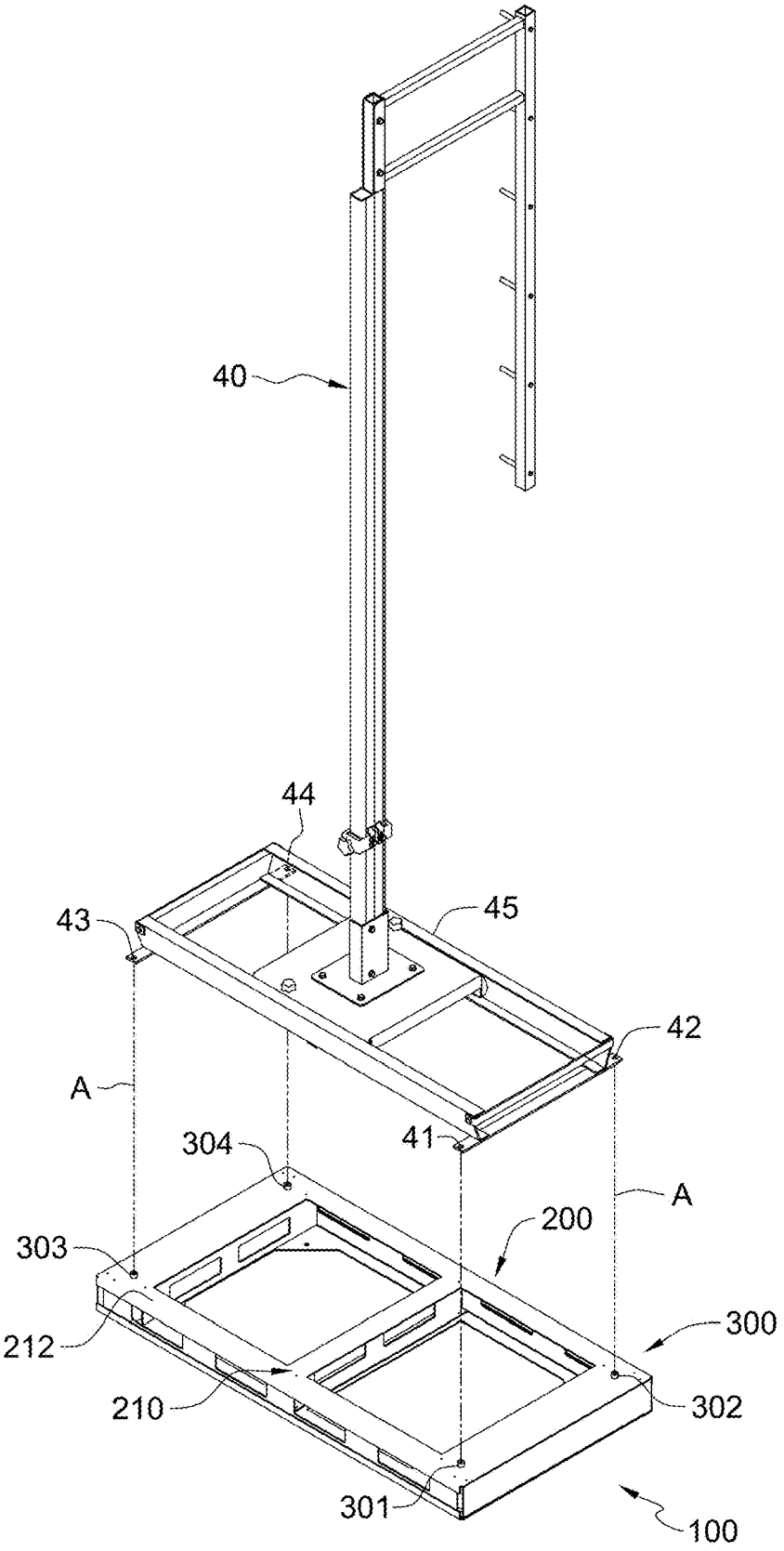
FIG. 2 is an enlarged, exploded perspective view of one of the pole vault standards and pole vault standard foundation forms of FIG. 1.

FIG. 2 illustrates an exploded view of pole vault standard 40 and first pole vault standard foundation form 100 for constructing a foundation for anchoring pole vault standard 40. As described in greater detail below, first foundation form 100 may include a first frame 200 and a first plurality of connectors 300 (e.g., connectors, 301, 302, 303, and 304) defining a first connecting pattern for coupling to a corresponding connecting pattern (e.g., holes 41, 42, 43, and 44) of first base 45 of first pole vault standard 40 with a plurality of bolts (not shown in FIG. 2). When foundation form 100 is employed in forming foundation 80 (FIG. 1) in the support structure adjacent in the landing area, as described in greater detail below, the corresponding connecting pattern of first base 45 of first pole vault standard 40 may be aligned and readily connectable to first connecting pattern of connectors 300 of foundation form 100 for readily fixedly connecting first base 45 of first pole vault standard 40 to first foundation 80 (FIG. 1). Second foundation form 400 (FIG. 1) may be similarly configured and installed as foundation form 100 described below. For example, second foundation form 400 (FIG. 1) may include a second frame and a second plurality of connectors defining a second connecting pattern for coupling to a corresponding connecting pattern of second base 55 (FIG. 1) of second pole vault standard 50 (FIG. 1).

Figure 3:
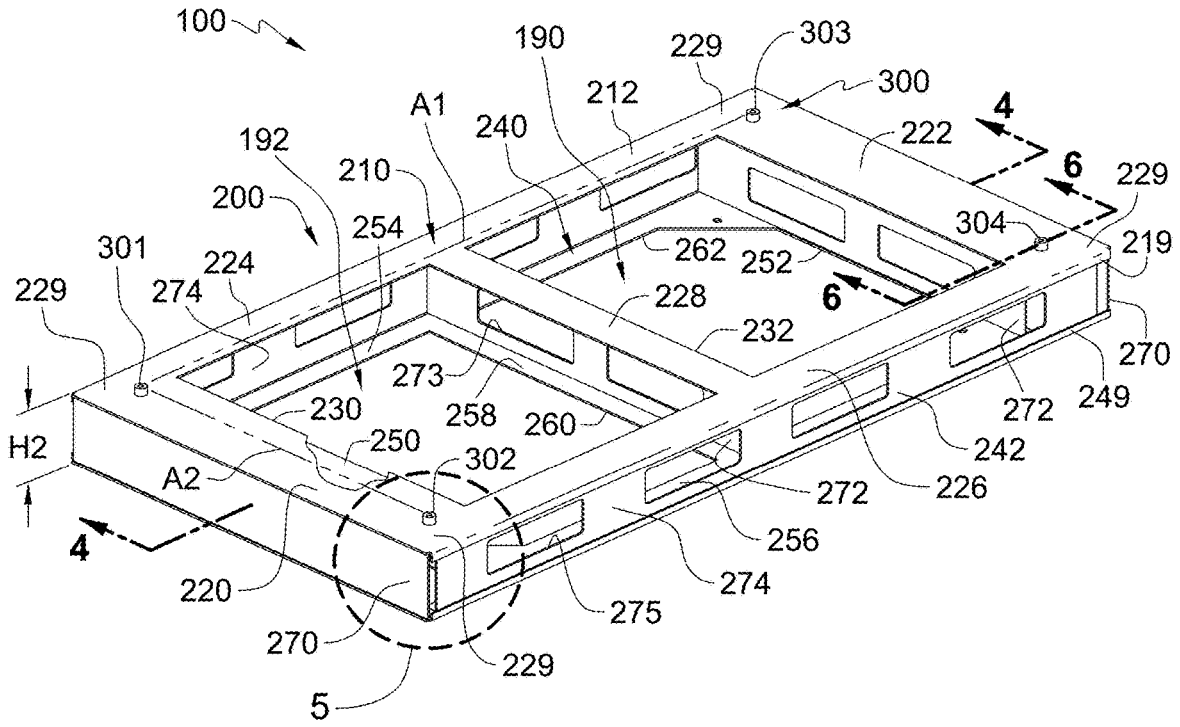
FIG. 3 is an enlarged perspective view of the pole vault standard foundation form of FIG. 2 for constructing a foundation for anchoring a pole vault standard.

As shown in FIG. 3, first pole vault standard foundation form 100 may include frame 200 formed from a top plate 210 having a top surface 212 and a bottom surface (not shown in FIG. 3), a bottom plate 240 having top surface 242 and a bottom surface (not shown in FIG. 3), and a plurality of spacers 270 and 272 and a plurality of slats 201 disposed therebetween. Top plate 210 may include a first minor top peripheral edge portion 220, a second minor top peripheral edge portion 222, a first major top peripheral edge portion 224, a second major top peripheral edge portion 226, and a top cross-member 228 extending between first major top peripheral edge portion 224 and second major top peripheral edge portion 226. In this illustrated embodiment, the top peripheral portions define a first opening 230 and a second opening 232. The first and second major top peripheral edge portions and the first and second minor top peripheral edge portions may be disposed at right angles to each other to define a plurality of corners 229.

Bottom plate 240 may include a first minor bottom peripheral edge portion 250, a second minor bottom peripheral edge portion 252, a first major bottom peripheral edge portion 254, a second major bottom peripheral edge portion 256, and a bottom cross-member 258 extending between the first major bottom peripheral edge portion 254 and second major bottom peripheral edge portion 256. In this illustrated embodiment, the bottom peripheral portions define a first opening 260 and a second opening 262. The first and second major bottom peripheral edge portions and the first and second minor bottom peripheral edge portions may be disposed at right angles to each other to define a plurality of corners (not shown).

Figure 4:
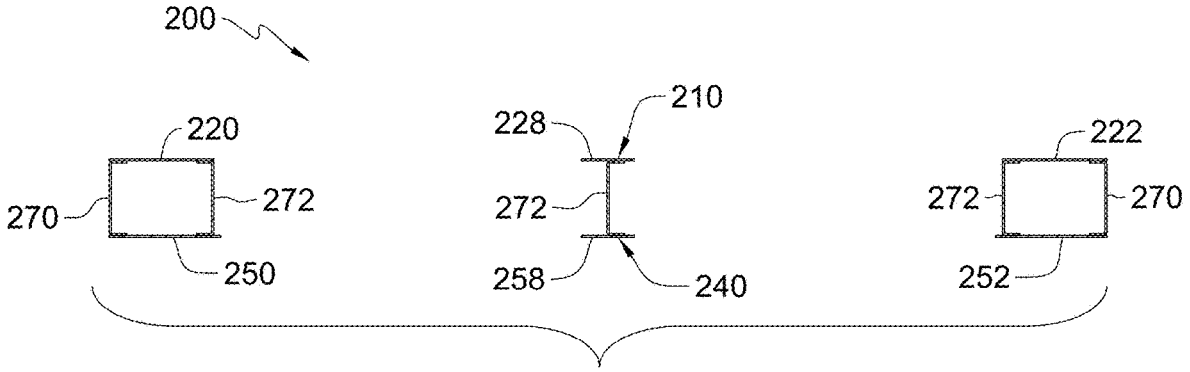
FIG. 4 is a cross-sectional view taken along line 4-4 in FIG. 3.

As shown in FIGS. 3 and 4, top plate 210 is spaced from and connected to bottom plate 240 with the plurality of spacers 270, 272, and 274. For example, a pair of first spacers 270 and 272 may be disposed between first minor top peripheral edge portion 220 and first minor bottom peripheral edge portion 250. A pair of second spacers 270 and 272 may be disposed between second minor top peripheral edge portion 222 and second minor bottom peripheral edge portion 252. A spacer 272 may be disposed between top cross-member 228 and bottom cross-member 258. One of spacers 274 may be disposed between first major top peripheral edge portion 224 (FIG. 3) and first major bottom peripheral edge portion 254 (FIG. 3), and the other of spacers 274 may be disposed between second major top peripheral edge portion 226 and second major bottom peripheral edge portion 256. Spacers 272 may be provided with one or more openings 273 (FIG. 3). Spacers 274 may be provided with one or more openings 275 (FIG. 3). First frame 100 defines a first and second interior spaces or cavities 190 and 192.

Figure 5:
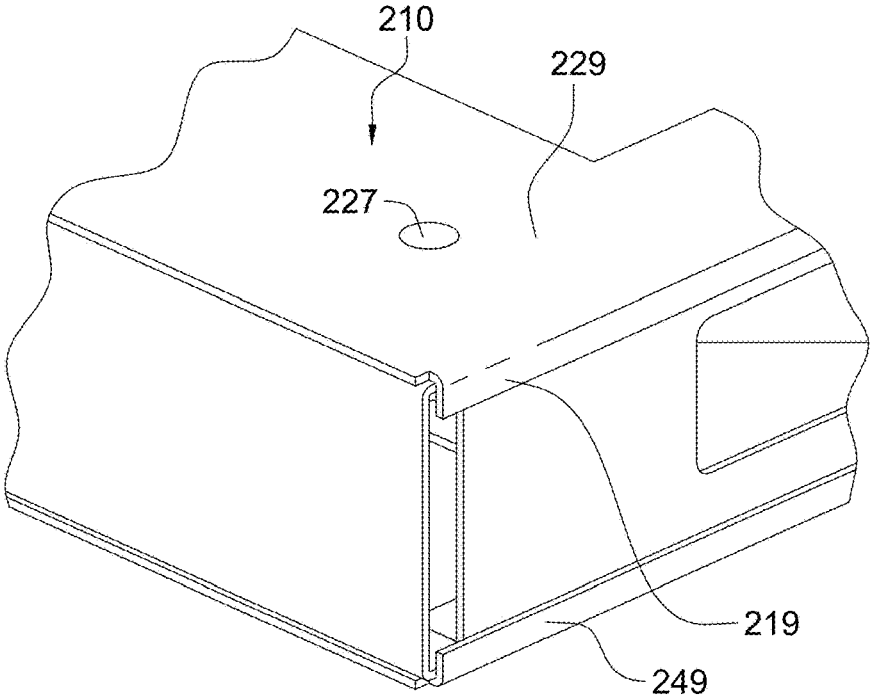
FIG. 5 is an enlarged, partial perspective view of detail 5 of FIG. 3 without the connector.

Top plate 210 along first major top peripheral edge portion may be provided with a downwardly depending tab or lip 219 (best shown in FIG. 5), and bottom plate 240 along a first major bottom peripheral edge portion may be provided with an upwardly-depending tab or lip 249 (best shown in FIG. 5). The other major peripheral edge portions of top plate 210 and bottom plate 240 may be similar configured. The inside surface of the tabs may be spaced from the outer surfaces of spacers 274 to define top and bottom gaps or slots therebetween.

In some embodiments, the top plate, the bottom plate, and the spacers may be formed from aluminum or other suitable metal or other material. In some embodiments, the spacers may be C-channels such as aluminum C-channels. The various components of the first frame may be suitable riveted, bolted, welded, or otherwise suitably assembled and connected together. In other embodiments, for example, a bottom plate and the first and the second outer spacers may be integrally formed as a monolithic structure. For example, peripheral minor sides of the bottom plate may be bent upwards to form first and second spacers. While the first frame may include a single cross member between two openings in the top plate and bottom plate, it will be appreciated that the top and bottom plates may include one (no cross member) or more than two openings with cross members disposed therebetween. Other variations of the placement of the openings and cross member may be suitable employed. The spacers may provide sufficient rigidity to the frame.

With reference again to FIG. 2, first frame 100 may define a hollow rectangular cuboid. The two major peripheral sides may be substantially parallel to one another and the two minor peripheral sides may be substantially parallel to one another. The spacers may be disposed normal to the top and bottom plates. The major sides are larger than the minor sides.

As shown in FIG. 5, top plate 210 may be provided in each corner 229 with an aperture or a through hole 227 (only one corner being shown in FIG. 5) for receiving connectors 300 (FIG. 1) as described below.

Figure 6:
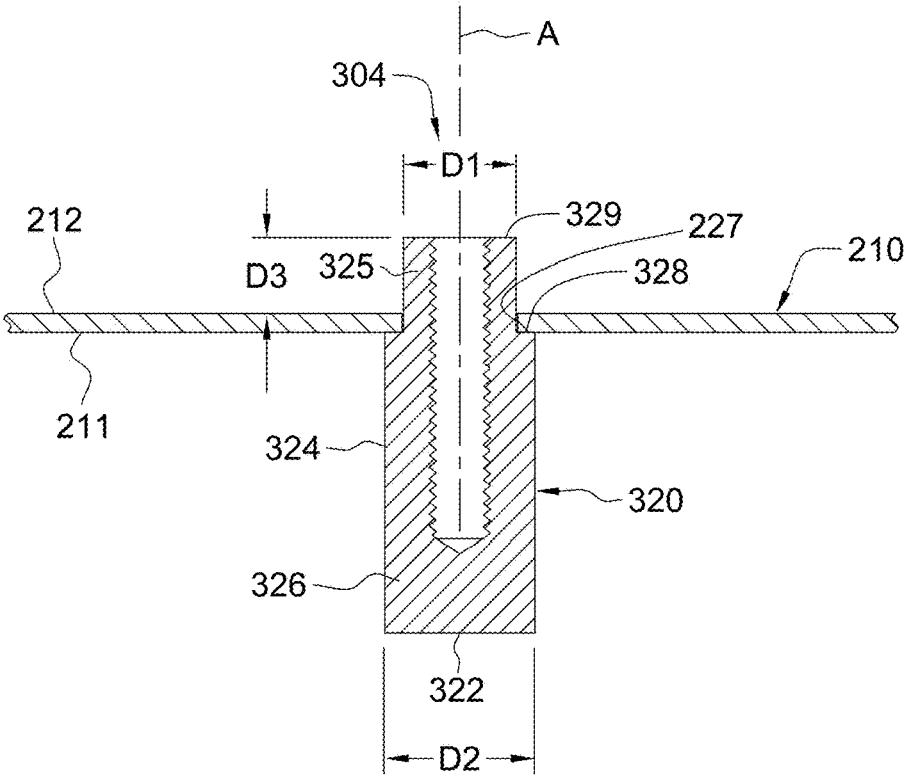
FIG. 6 is an enlarged, partial, cross-sectional view taken along line 6-6 in FIG. 3.

FIG. 6 illustrates connector 304 disposed in corner 229 (FIG. 3) of top plate 210. For example, connector 304 may be a threaded bushing, insert, or slug. For example, connector 304 may include a hollow body 320 defining a bottom wall 322 and a side wall 324. Side wall 324 may have an upper portion 325 having an outer diameter D1 and a lower portion having a diameter D2, which upper and lower portions define a stop 328 disposed therebetween. When assembled, upper portion of connector 304 is inserted in hole 227 of top plate 210 so that stop 328 abuts a bottom surface 211 of top plate 210 and an upper surface 329 of connector 304 extends above top surface 212 of top plate 210 a distance D3. Connector 304 includes an opening having internal thread and defining an axis A. Connectors 301, 302, and 303 may be similarly configured and connected to top plate 210 as described above in connection with connector 304. Diameter D1 of upper portion 325 of the connector may be sized to be press fitted into hole 227 of top plate 210.

With reference again to FIG. 2, axes A may be disposed parallel to each other and perpendicular or at 90 degrees from top surface 212 of top plate 210. Connectors 300 are positioned and arranged to align with the corresponding positioned and arranged connectors of a pole vault standard.

Figure 7:
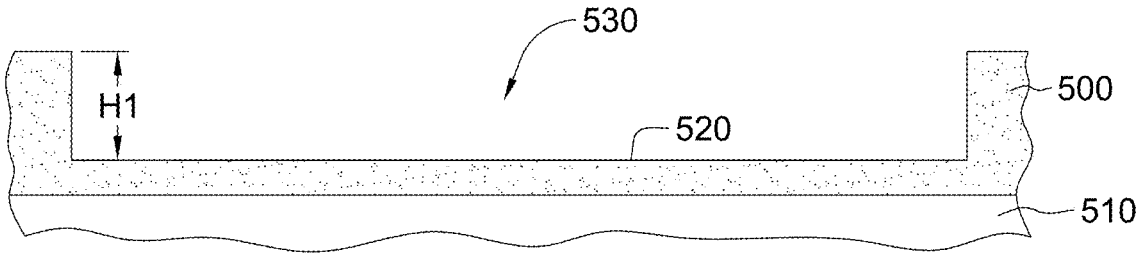
FIG. 7 is a cross-sectional view of a cavity formed in a support structure of an athletic field.

FIGS. 7-11 illustrate a method for installing the pole vault standard foundation forms for constructing foundations for securing pole vault standards according to an embodiments of the present disclosure. Initially, as shown in FIG. 7, a landing pad area may include a layer 500 of asphalt disposed on the ground 510. Asphalt layer 500 is excavated to provide a cavity 530 having a depth H1 sized and corresponding to a height H2 (FIG. 3) of foundation form 100 (FIG. 3), and having a length and width sized larger than the length and width of foundation form 100 (FIG. 3).

Figure 8:
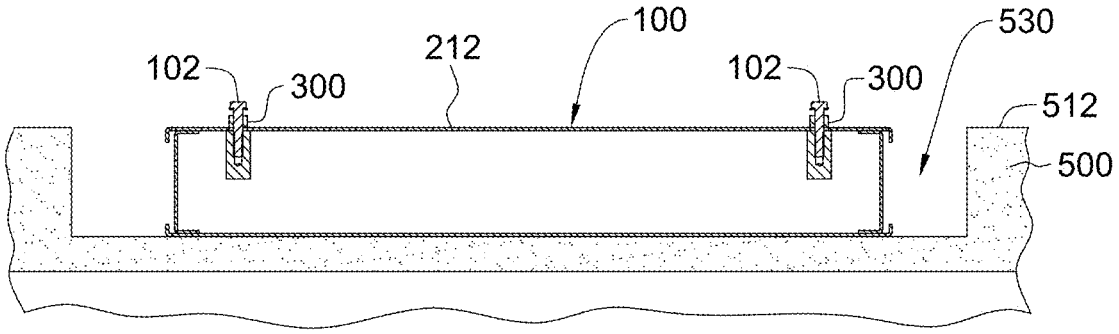
FIG. 8 is a cross-sectional view of a pole vault standard foundation form disposed in the cavity of FIG. 7.

As shown in FIG. 8, pole vault standard foundation form 100 is placed in cavity 530 so that top surface 212 is disposed level with top surface 512 of asphalt layer 500. With reference again to FIG. 3, foundation form 100 may be positioned in cavity 530 (FIG. 7) so that an axis A1 spanning between connectors 301 and 303 is disposed parallel to approach 75 (FIG. 1), and an axis A2 spanning between connectors 301 and 302 is disposed perpendicular to approach 75 (FIG. 1). Bolts 102 may be installed in connectors 300 of foundation form 100. For example, leaving bolts 102 inserted throughout the initial installation process prevents debris or water from entering the threaded connectors.

Figure 9:
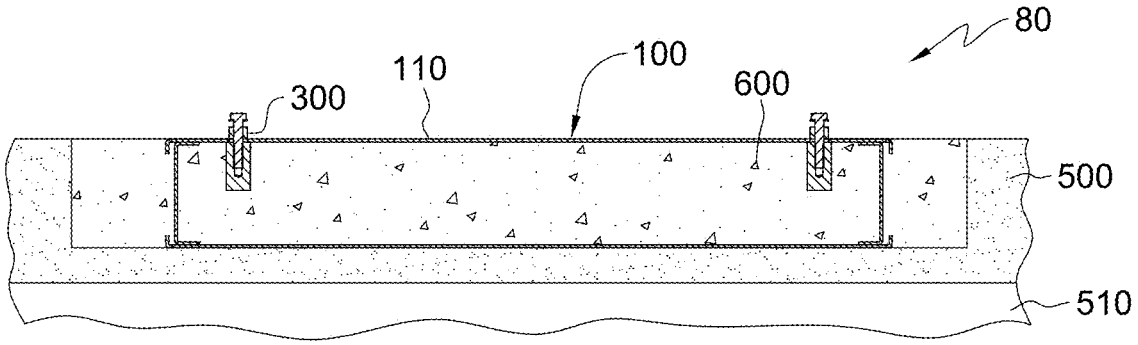
FIG. 9 is a cross-sectional view of the pole vault standard foundation form and cavity of FIG. 8 filled with concrete.

As shown in FIG. 9, uncured concrete 600 is poured in cavity 530 (FIG. 8) and in cavities 190 and 192 (FIG. 3) of foundation form 100, and cured so that frame 110 and connectors 300 may be anchored to asphalt 500 and the ground 510 to define first foundation 80.

Figure 10:
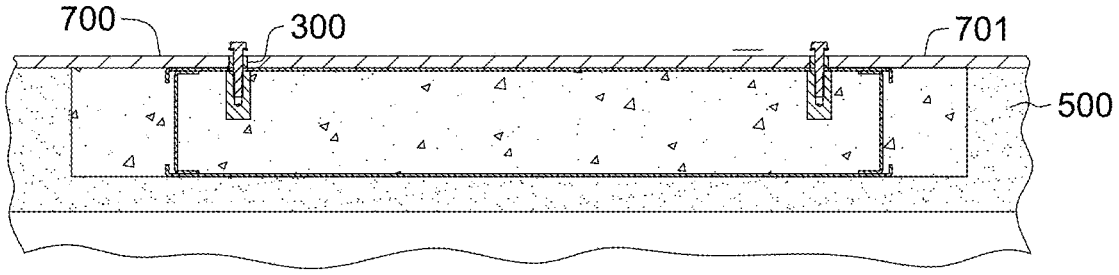
FIG. 10 is a cross-sectional view of the pole vault standard foundation form and cavity filled with concrete of FIG. 9 covered with a resilient track material.

With reference to FIG. 10, a track layer 700 may be installed on top of the upper surface of asphalt 500, the upper surface of cured concrete 600, and the upper surface of foundation form 100. A top surface 701 of track layer 700 may be disposed even with the top surface of connectors 300. The track layer may be resilient rubber track material. The top of the connectors may sit flush with the finished track surface.

Figure 11:
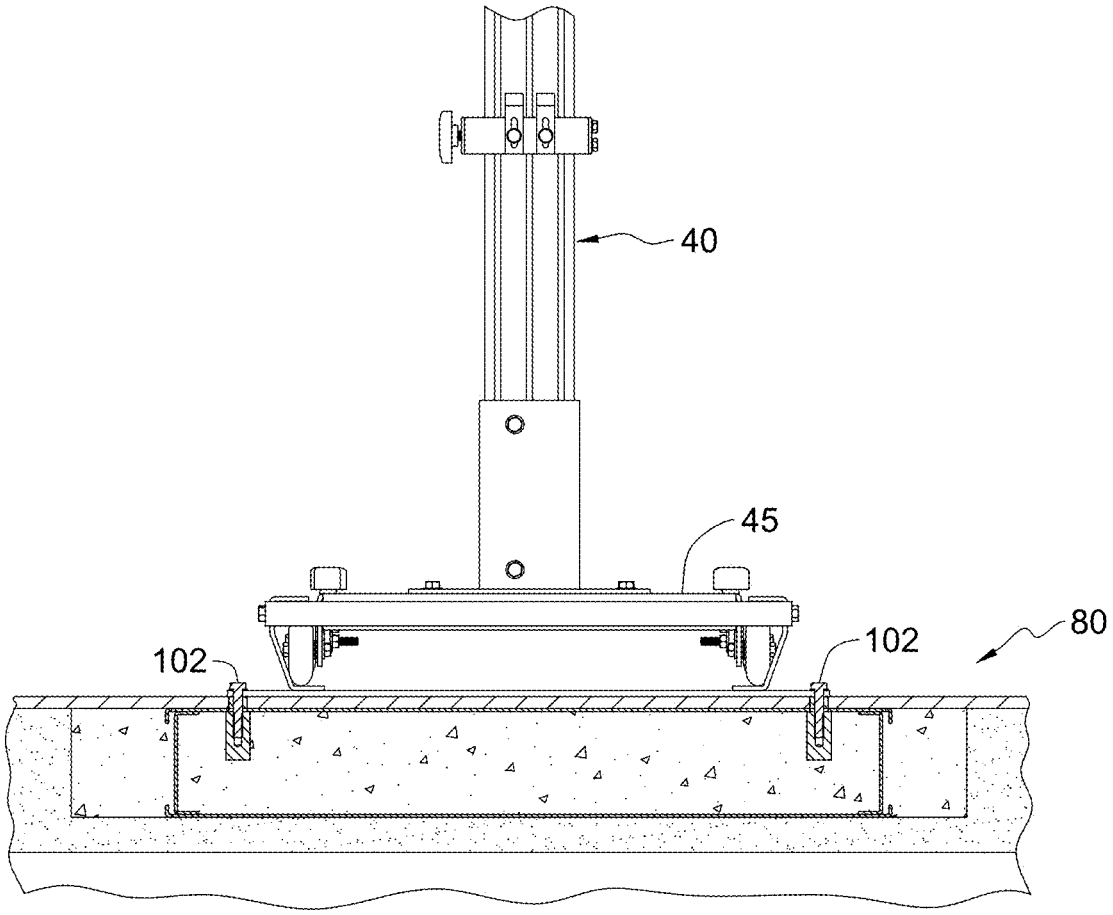
FIG. 11 is a cross-sectional view of a base of a pole vault standard attached to the installed pole vault standard foundation form of FIG. 10.

As shown in FIG. 11, base 45 of pole vault standard 40 may be readily connected to first foundation 80 using bolts 102. For example, base 45 may have a plurality of holes aligned with the openings in connectors 300. Installation of second foundation form 400 may be similarly installed as described above in connection with foundation form 100.

Figure 12:
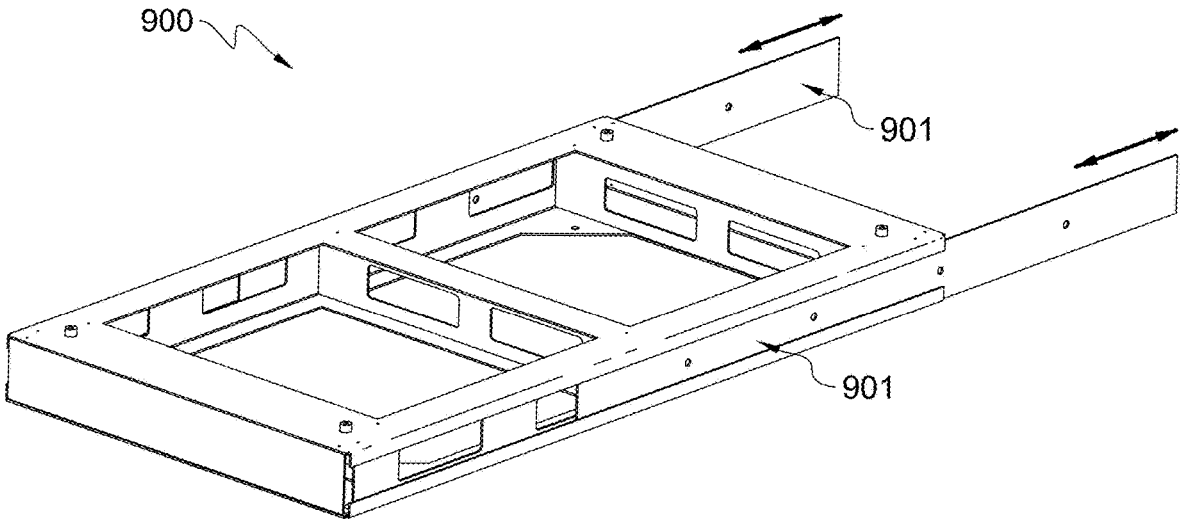
FIG. 12 is a perspective view of a pole vault standard foundation form for constructing a foundation for anchoring a pole vault standard according to an embodiment of the present disclosure.

FIG. 12 illustrates a pole vault standard foundation form 900 according to an embodiment of the present disclosure. Foundation form 900 is essentially the same as foundation form 100 (FIG. 2) with the exception of slidable solid sides or slats 901. For example, slats 901 may be receivable in the top and the bottom gaps or slots formed between the inside surface of the tabs and outer surfaces of spacers along the major sides of the form to cover the openings in the spacers. Foundation form 900 may be desired in some applications where concrete is poured outside the perimeter of the form in addition to within the foundation form.

In other applications, the entire footprint of the pole vault area/pad is constructed with monolithic concrete so that foundation form 900 would be set within a larger hand-formed area in which the uncured concrete gets poured at once. In such a case, rather than the sides of the form acting as a dam, the two slats may be removed so the uncured concrete can flow unrestricted.

Figure 13:
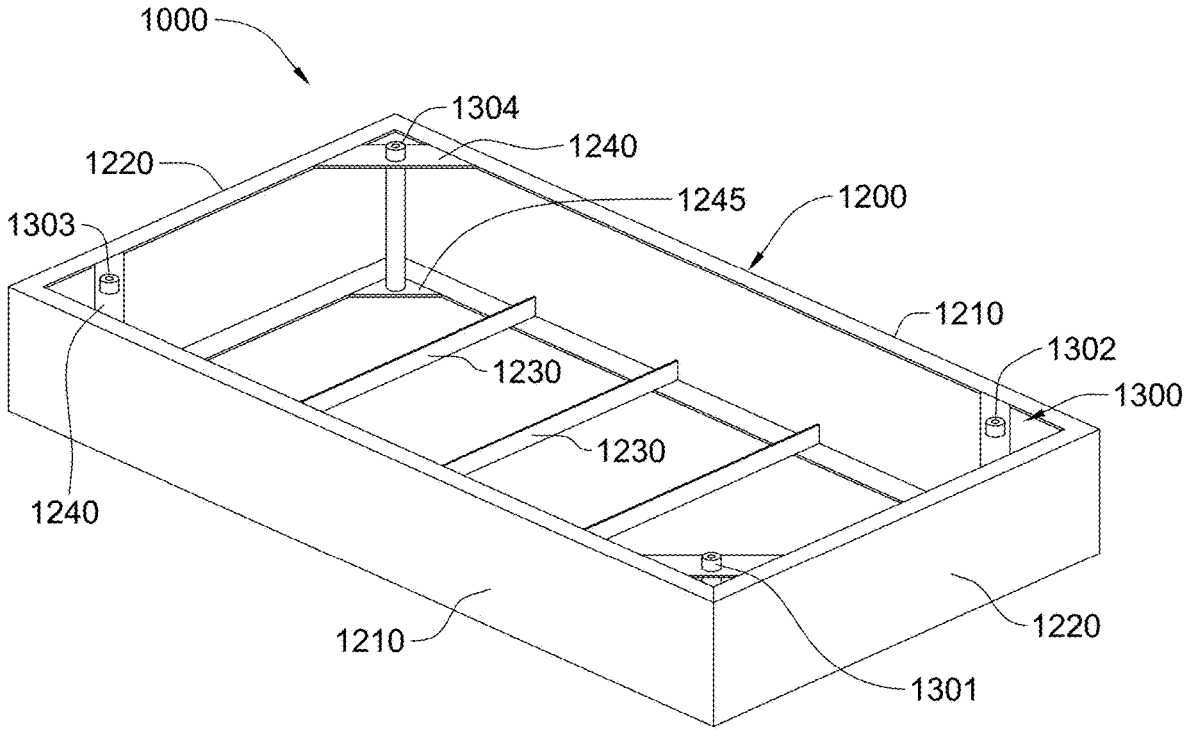
FIG. 13 is a perspective view of a pole vault standard foundation form for constructing a foundation for anchoring a pole vault standard according to an embodiment of the present disclosure.

FIG. 13 illustrates a pole vault standard foundation form 1000 according to an embodiment of the present disclosure. Form 1000 may include a frame 1200 having major parallel sides 1210, minor parallel sides 1220, cross supports 1230, and diagonals 1240 and 1245 (only one of which is shown) disposed in the corners of frame 1200. Form 1000 may further include a first plurality of connectors 1300 (e.g., connectors, 1301, 1302, 1303, and 1304) defining a first connecting pattern for coupling to a corresponding connecting pattern (e.g., holes of a base of a pole vault standard with a plurality of bolts).

Figure 14:
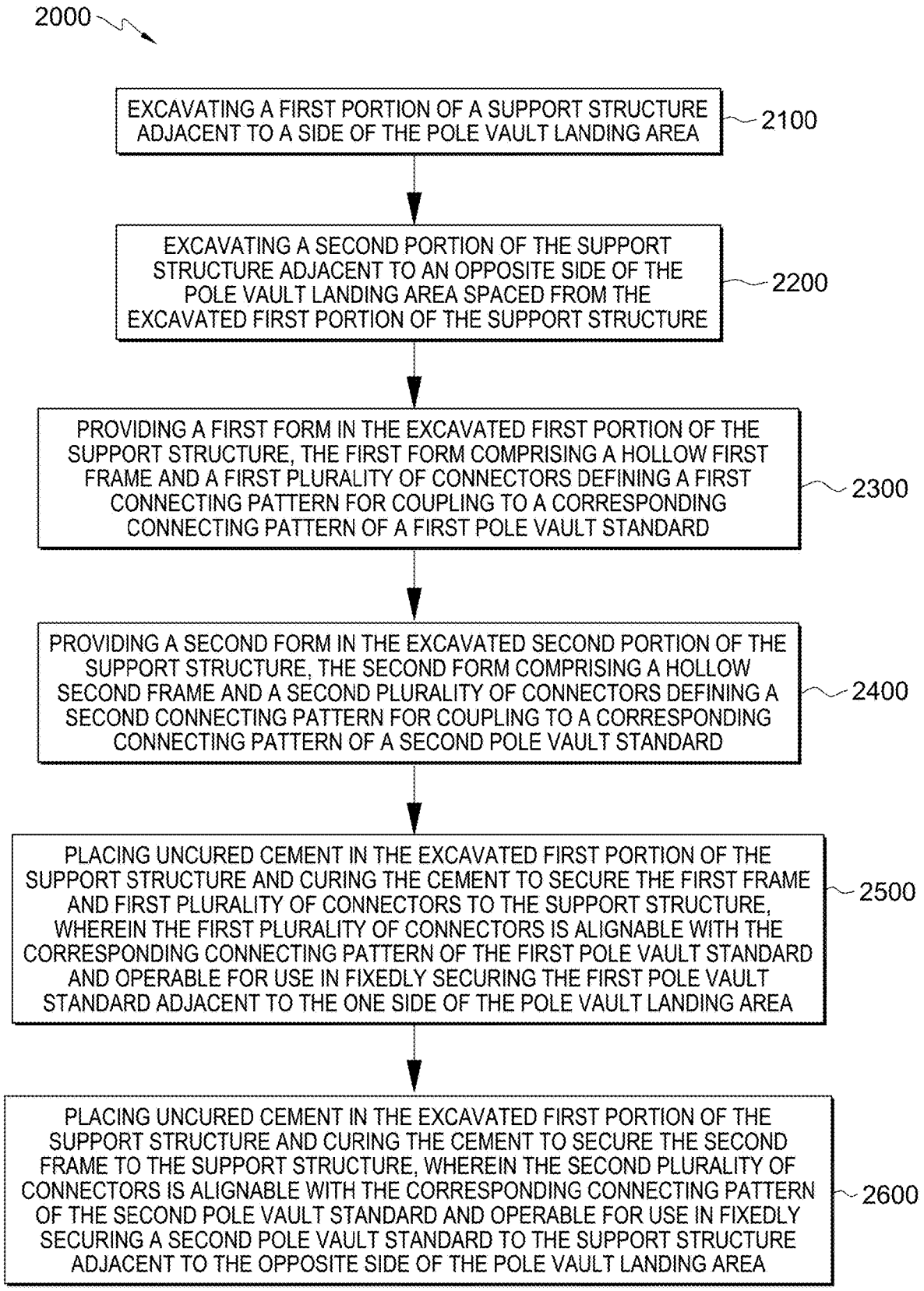
FIG. 14 is a flowchart of a method for constructing a foundation for anchoring a pole vault standard according to an embodiment of the present disclosure.

FIG. 14 illustrates a method 2000 for forming a first foundation and a second foundation adjacent to a pole vault landing area for anchoring a first pole vault standard and a second pole vault standard. Method 2000 includes at 2100 excavating a first portion of the ground adjacent to one side of a pole vault landing area, and at 2200 excavating a second portion of the ground adjacent to an opposite side of the pole vault landing area spaced from the excavated first portion of the ground. At 2300 a first form is provided in the excavated first portion of the ground, and at 2400 a second form is provided in the excavated first portion of the ground. The first form includes a hollow first frame and a first plurality of connectors defining a first connecting pattern for coupling to a corresponding connecting pattern of a first pole vault standard. The second form includes a hollow second frame and a second plurality of connectors defining a second connecting pattern for coupling to a corresponding connecting pattern of a second pole vault standard. At 2500, uncured cement is placed in the excavated first portion of the ground and the cement is cured to secure the first frame and first plurality of connectors to the ground wherein the first plurality of connectors is alignable with a corresponding connecting pattern of the first pole vault standard and operable for use in fixedly securing the first pole vault standard adjacent to the one side of the pole vault landing area. At 2600, uncured cement is placed in the excavated second portion of the ground and the cement is cured to secure the second frame and second plurality of connectors to the ground wherein the second plurality of connectors is alignable with the corresponding connecting pattern of the second pole vault standard and operable for use in fixedly securing a second pole vault standard to the ground adjacent to the opposite side of the pole vault landing area.

From the present description, benefits of the present disclosure include forming systems that may provide a quality control in lieu of forming by hand, ensuring proper size and depth, allowing for a resilient rubber coating, and providing predetermined and reusable anchoring points which may be located visually at the finished surface elevation with minimal exposure. An end user may benefit from hardware flexibility if the base needs to be shimmed/leveled; i.e., the bolt depth can be altered while maintaining security, as compared to concrete wedge/expansion anchors that rely on the depth of the bolt for proper engagement. Furthermore, the end user may have the ability to fully remove the bolts if not in use, and may replace the bolts should they rust or wear, both characteristics being in contrast to conventional foundations having epoxied threaded rods which would be left protruding from the surface should the pole vault equipment be moved or temporarily placed into storage.

It is to be understood that the above description is intended to be illustrative, and not restrictive. For example, the above-described embodiments and/or features thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that features of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A pair of forms for constructing a first foundation and a second foundation for anchoring a first pole vault standard and a second pole vault standard to a support structure adjacent to a landing pad, said pair of forms comprising:

a first form comprising a first frame and a first plurality of connectors defining a first connecting pattern for coupling to a corresponding connecting pattern of a first base of the first pole vault standard, said first frame comprises a first upper surface, and said first plurality of connectors extending above said first upper surface of said first frame, and wherein said first form is fixedly installable in the support structure and operable for use in fixedly connecting the first base of the first pole vault standard to said first form;

a second form comprising a second frame and a second plurality of connectors defining a second connecting pattern for coupling to a corresponding connecting pattern of a second base of the second pole vault standard, said second frame comprises a second upper surface, and said second plurality of connectors extending above said second upper surface of said second frame, and wherein said second form is fixedly installable in the support structure and operable for use in fixedly connecting the second base of the second pole vault standard to said second form; and wherein said first plurality of connectors comprises internally threaded apertures, and said second plurality of connectors comprises internally threaded apertures.

2. The pair of forms of claim 1 wherein said first plurality of connectors comprises threads connectable to a first plurality of fastening members for fixedly connecting the first base of the first pole vault standard to said first form, and said second plurality of connectors comprises threads connectable to a second plurality of fastening members for fixedly connecting the second base of the second pole vault standard to said second form.

3. The pair of forms of claim 1 wherein said first form comprises an upper surface, said first internally threaded apertures having a first axis and said first axis being 90-degrees from said first upper surface, and wherein said second form comprises an upper surface, said second internally threaded apertures having a second axis and said second axis being 90-degrees from said second upper surface.

4. The pair of forms of claim 1 wherein each of said first frame and said second frame comprises a hollow cuboid configuration.

5. The pair of forms of claim 1 wherein said first frame comprises a rectangular first top plate and spaced apart rectangular first bottom plate, and said second frame comprises a second top plate and spaced apart second bottom plate.

6. The pair of forms of claim 5 wherein each of said first frame and said second frame comprises a plurality of removable sides.

7. The pair of forms of claim 5 wherein a different one of said first plurality of connectors is disposed adjacent to a corner of said first top plate of said first form, and a different one of said second plurality of connectors is disposed adjacent to a corner of said second top plate of said second form.

8. The pair of forms of claim 5 further comprising at least one first spacer extending between said first top plate and said first bottom plate, and further comprising at least one second spacer extending between said second top plate and said second bottom plate.

9. The pair of forms of claim 1 wherein said first and second frames comprise metal.

10. The pair of forms of claim 1 further comprising a plurality of bolts extendable through holes in the pair of pole vault standards and connectable to said connectors of said first and second forms.

11. The pair of forms of claim 1 further comprising the first pole vault standard and the second pole vault standard.

12. The pair of forms of claim 1 further comprising the landing pad.

13. The pair of forms of claim 1 further comprising a resilient track material disposable over and around said pair of forms, a pole vault box positionable between said first form and said second form, or a crossbar.

14. The pair of forms of claim 1 wherein:

said first frame comprises:

a first top plate comprising a peripheral edge portion defining at least one opening through said first top plate; and said second frame comprises:

a second top plate comprising a peripheral edge defining at least one opening through said second top plate.

15. The pair of forms of claim 1 wherein:

said first frame comprises a first top plate comprising a first minor peripheral edge portion, a second minor peripheral edge portion, a first major peripheral edge portion, a second major peripheral edge portion, and a cross-member extending between said first major peripheral edge portion and second major peripheral edge portion to define a first opening and a second opening;

said first frame comprises a first bottom plate comprising a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening;

said second frame comprises a second top plate comprising a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening; and said second frame comprises a second bottom plate comprising a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening.

16. The pair of forms of claim 1 wherein:

said first frame comprises:

a rectangular first top plate comprising a peripheral edge portion defining at least one opening through said rectangular first top plate;

a rectangular first bottom plate comprising a peripheral edge portion defining at least one opening through said rectangular first bottom plate;

said second frame comprises:

a second top plate comprising a peripheral edge portion defining at least one opening through said second top plate; and a second bottom plate comprising a peripheral edge portion defining at least one opening through said second bottom plate.

17. The pair of forms of claim 1 wherein:

said first frame comprises a rectangular first top plate comprising a first minor peripheral edge portion, a second minor peripheral edge portion, a first major peripheral edge portion, a second major peripheral edge portion, and a cross-member extending between said first major peripheral edge portion and second major peripheral edge portion to define a first opening and a second opening;

said first frame comprises a rectangular first bottom plate comprising a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening;

said second frame comprises a rectangular second top plate having a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening; and said second frame comprises a rectangular second bottom plate having a first minor peripheral edge portion, a second minor peripheral edge portion, a first major peripheral edge portion, a second major peripheral edge portion, and a cross-member extending between said first major peripheral edge portion and said second major peripheral edge portion to define a first opening and a second opening.

18. The pair of forms of claim 17 wherein said first form comprises an upper surface, said first internally threaded apertures having a first axis and said first axis being 90-degrees from said first upper surface, and wherein said second form comprises an upper surface, said second internally threaded apertures having a second axis and said second axis being 90-degrees from said second upper surface.

19. The pair of forms of claim 1 wherein said first frame comprises at least one first spacer extending between a first top plate and a first bottom plate and comprising at least one opening, and said second frame comprises at least one second spacer extending between a second top plate and a second bottom plate and comprising at least one opening.

20. The pair of forms of claim 19 wherein said at least one first spacer being disposed between a peripheral portion of said first top plate and a peripheral portion of said first bottom plate, and said at least one second spacer being disposed between a peripheral portion of said second top plate and a peripheral portion of said second bottom plate.

21. The pole vault system of claim 14 wherein:

said first frame comprises a first bottom plate comprising a peripheral edge portion defining at least one opening through said first bottom plate; and said second frame comprises a second bottom plate comprising a peripheral edge defining at least one opening through said second bottom plate.

22. A pole vault system comprising:

a first pole vault standard comprising a first base having a connecting pattern;

a second pole vault standard comprising a second base having a connecting pattern;

a first form comprising a first frame and a first plurality of connectors defining a first connecting pattern for coupling to said connecting pattern of said first base of said first pole vault standard, said first frame comprising a first top plate comprising a peripheral edge portion defining at least one opening through said first top plate and a first bottom plate comprising a peripheral edge portion defining at least one opening through said first bottom plate, and wherein said first form is fixedly installable in the support structure and operable for use in fixedly connecting said first base of said first pole vault standard to said first form; and a second form comprising a second frame and a second plurality of connectors defining a second connecting pattern for coupling to said connecting pattern of said second base of said second pole vault standard, said second frame comprising a second top plate comprising a peripheral edge defining at least one opening through said second top plate, and a second bottom plate comprising a peripheral edge portion defining at least one opening through said second bottom plate, and wherein said second form is fixedly installable in the support structure and operable for use in fixedly connecting said second base of said second pole vault standard to said second form.

23. The pole vault system of claim 22 wherein said first plurality of connectors comprises threads connectable to a first plurality of fastening members for fixedly connecting the first base of the first pole vault standard to said first form, and said second plurality of connectors comprises threads connectable to a second plurality of fastening members for fixedly connecting the second base of the second pole vault standard to said second form.

24. The pole vault system of claim 22 wherein each of said first frame and said second frame comprises a hollow cuboid configuration.

25. The pole vault system of claim 22 wherein said first frame comprises at least one first spacer extending between a first top plate and a first bottom plate and comprising at least one opening, and said second frame comprises at least one second spacer extending between a second top plate and a second bottom plate and comprising at least one opening.

26. The pole vault system of claim 25 wherein said at least one first spacer being disposed between a peripheral portion of said first top plate and a peripheral portion of said first bottom plate, and said at least one second spacer being disposed between a peripheral portion of said second top plate and a peripheral portion of said second bottom plate.

27. The pole vault system of claim 22 further comprising a pole vault box positionable between said first form and said second form, a landing pad positionable between said first form and said second form, a crossbar, or a resilient track material disposable over and around said first form and said second form.

28. The pole vault system of claim 22 wherein:

said first plurality of connectors extend above an upper surface of said first top plate; and said second plurality of connectors extend above an upper surface of said second top plate.

29. The pole vault system of claim 22 wherein:

each of said first frame and said second frame comprises at least one removable side.

30. A pole vault system comprising:

a first pole vault standard comprising a first base having a connecting pattern;

a second pole vault standard comprising a second base having a connecting pattern;

a first form comprising a first hollow frame with a first plurality of connectors defining a first connecting pattern for coupling to said connecting pattern of said first base of said first pole vault standard, and wherein said first form is fixedly installable in a support structure and operable for use in fixedly connecting said first base of said first pole vault standard to said first form; and a second form comprising a second hollow frame with a second plurality of connectors defining a second connecting pattern for coupling to said connecting pattern of said second base of said second pole vault standard, and wherein said second form is fixedly installable in the support structure and operable for use in fixedly connecting said second base of a second pole vault standard to said second form.

31. The pole vault system of claim 30 wherein said first plurality of connectors comprises threads connectable to a first plurality of fastening members for fixedly connecting said first base of said first pole vault standard to said first form, and said second plurality of connectors comprises threads connectable to a second plurality of fastening members for fixedly connecting said second base of said second pole vault standard to said second form.

32. The pole vault system of claim 30 wherein said first frame comprises at least one first spacer extending between a first top plate and a first bottom plate and comprising at least one opening, and said second frame comprises at least one second spacer extending between a second top plate and a second bottom plate and comprising at least one opening.

33. The pole vault system of claim 32 wherein said at least one first spacer being disposed between a peripheral portion of said first top plate and a peripheral portion of said first bottom plate, and said at least one second spacer being disposed between a peripheral portion of said second top plate and a peripheral portion of said second bottom plate.

34. The pole vault system of claim 30 further comprising a pole vault box positionable between said first form and said second form, a landing pad positionable between said first form and said second form, a crossbar, or a resilient track material disposable over and around said first form and said second form.

35. The pole vault system of claim 30 wherein:

said first frame comprises a first top plate comprising a peripheral edge portion defining at least one opening through said first top plate; and said second frame comprises a second top plate comprising a peripheral edge defining at least one opening through said second top plate.

36. The pole vault system of claim 30 wherein:

said first plurality of connectors extend above an upper surface of said first frame; and said second plurality of connectors extend above an upper surface of said second frame.

37. The pole vault system of claim 30 wherein:

each of said first frame and said second frame comprises at least one removable side.

38. A pair of forms for constructing a first foundation and a second foundation for anchoring a first pole vault standard and a second pole vault standard to a support structure adjacent to a landing pad, said pair of forms comprising:

a first form comprising a first frame and a first plurality of connectors defining a first connecting pattern for coupling to a corresponding connecting pattern of a first base of the first pole vault standard, and wherein said first form is fixedly installable in the support structure and operable for use in fixedly connecting the first base of the first pole vault standard to said first form;

a second form comprising a second frame and a second plurality of connectors defining a second connecting pattern for coupling to a corresponding connecting pattern of a second base of the second pole vault standard, and wherein said second form is fixedly installable in the support structure and operable for use in fixedly connecting the second base of the second pole vault standard to said second form; and wherein each of said first frame and said second frame comprises a plurality of removable sides.

39. A pair of forms for constructing a first foundation and a second foundation for anchoring a first pole vault standard and a second pole vault standard to a support structure adjacent to a landing pad, said pair of forms comprising:

a first form comprising a first frame and a first plurality of connectors defining a first connecting pattern for coupling to a corresponding connecting pattern of a first base of the first pole vault standard, and wherein said first form is fixedly installable in the support structure and operable for use in fixedly connecting the first base of the first pole vault standard to said first form;

a second form comprising a second frame and a second plurality of connectors defining a second connecting pattern for coupling to a corresponding connecting pattern of a second base of the second pole vault standard, and wherein said second form is fixedly installable in the support structure and operable for use in fixedly connecting the second base of the second pole vault standard to said second form; and a pole vault box positionable between said first form and said second form.

40. A pair of forms for constructing a first foundation and a second foundation for anchoring a first pole vault standard and a second pole vault standard to a support structure adjacent to a landing pad, said pair of forms comprising:

a first form comprising a first frame and a first plurality of connectors defining a first connecting pattern for coupling to a corresponding connecting pattern of a first base of the first pole vault standard, and wherein said first form is fixedly installable in the support structure and operable for use in fixedly connecting the first base of the first pole vault standard to said first form;

a second form comprising a second frame and a second plurality of connectors defining a second connecting pattern for coupling to a corresponding connecting pattern of a second base of the second pole vault standard, and wherein said second form is fixedly installable in the support structure and operable for use in fixedly connecting the second base of the second pole vault standard to said second form; and wherein:

said first frame comprises:

a first top plate comprising a peripheral edge portion and a cross-member defining a first opening and a second opening through said first top plate;

a first bottom plate comprising a peripheral edge portion and a cross-member defining a first opening and a second opening through said first bottom plate;

said second frame comprises;

a second top plate comprising a peripheral edge and a cross-member defining a first opening and a second opening through said second top plate; and a second bottom plate comprising a peripheral edge portion and a cross-member defining a first opening and a second opening through said second bottom plate.

* * * * *